US007650003B1

(12) United States Patent
Hines

(10) Patent No.: US 7,650,003 B1
(45) Date of Patent: Jan. 19, 2010

(54) FLAT PANEL SPEAKER AND COMPONENTS THEREFOR

(76) Inventor: L. DuWayne Hines, 903 Wilmington Ave. - Apt. 311, Dayton, OH (US) 45420

( * ) Notice: Subject to any disclaimer, the term of this patent is extended or adjusted under 35 U.S.C. 154(b) by 809 days.

(21) Appl. No.: 11/298,815

(22) Filed: Dec. 9, 2005

Related U.S. Application Data

(60) Provisional application No. 60/636,170, filed on Dec. 15, 2004.

(51) Int. Cl.
*H04R 25/00* (2006.01)

(52) U.S. Cl. ..... 381/152; 381/401; 381/431

(58) Field of Classification Search ..... 381/152, 381/337, 182, 396, 398, 400, 401, 402, 409, 381/410, 423, 431
See application file for complete search history.

(56) References Cited

U.S. PATENT DOCUMENTS 3,247,925 A * 4/1966 Warnaka ..... 381/398
5,701,359 A 12/1997 Guenther et al.
6,332,029 B1 * 12/2001 Azima et al. ..... 381/152
6,333,575 B1 12/2001 Bank et al.
6,606,390 B2 8/2003 Azima
7,391,879 B2 * 6/2008 Beer et al. ..... 381/423

* cited by examiner

*Primary Examiner*—Huyen D Le
(74) *Attorney, Agent, or Firm*—Dinsmore & Shohl LLP

(57) ABSTRACT

A flat panel speaker. The speaker includes a drive unit made up of a signal oscillation radiator the winding of which promotes oscillating rather than translational movement of the radiator. Such a configuration allows the speaker to operate at a broad range of frequencies. In one form, the radiator includes a magnet, a coil former and a coil winding formed around the coil former in such a way that a magnetic field produced in the magnet can cooperate with a magnetic field induced by a current that corresponds to an audio signal flowing in the winding to produce an oscillating force in the radiator that can be converted into the oscillating movement imparted to the panel.

22 Claims, 7 Drawing Sheets

FLAT PANEL SPEAKER AND COMPONENTS THEREFOR

This application claims the benefit of the filing date of U.S. Provisional Application No. 60/636,170, filed Dec. 15, 2004.

BACKGROUND OF THE INVENTION

The present invention relates generally to a drive unit for transferring full-range audio signals from an amplifier to a flat panel, and more particularly to reproducing audio frequencies on a flat panel speaker.

There is an expanding market in home and automotive audio for high performance compact speakers. A similar demand for better sound and more compact construction for flat panel televisions is also in its ascendancy. In the past, there has been great difficulty in providing a flat panel loudspeaker that produces high quality sound in all of the high, middle and low frequency audio ranges. These difficulties are especially acute at the lower end of the sound spectrum (such as below one hundred hertz (Hz)), where limitations in the response of flat panel speakers typically require such speakers to be supplemented by a conventional woofer or subwoofer.

Conventional dynamic speakers use the electromagnetic interactions between a magnet and a voice coil to move a cone-shaped diaphragm back and forth. The cone of the speaker is suspended within a cabinet or related enclosure by a surround adjacent the outer periphery of the cone base and a spider adjacent the cone's apex. Piston-like movement of the cone pumps air in front of the cone, thereby producing sound. Conventional dynamic speakers employ a crossover network coupled to various cones of different sizes to improve the frequency response. One shortcoming of the conventional cone-based speaker is that its projection of sound is very directional, especially at the higher frequencies. By contrast, in flat panel speakers, the air used to produce sound is moved in short, fast vibrations using a large resonant panel that produces a more distributed sound with uniform, omnidirectional quality.

Flat panel speakers are advantageous in that their relatively low mass allows them to respond quickly to audio signal fluctuations, with concomitant increases in sound reproduction accuracy. Nevertheless, distinct problems in the reproduction of audio signals with flat panel speakers has been evidenced. One problem arises because the sound is produced by creating nudging vibrations on a panel, which at low frequencies (with their relatively large excursions) can cause panels to begin to act like pistons, resulting in a loss of acoustical output. This inherently limits the power handling and low-end frequency range of flat panel speakers, and may necessitate additional power sources (such as through a conventional electrical outlet plugged into the wall). Another problem is that a fixed panel decreases excursion potential, which greatly limits the reproduction of low-end audio frequencies, particularly in ranges below 100 Hz. In other words, since the panel doesn't move a great distance, it is not very effective at reproducing lower-frequency sounds. For this reason, flat panel speakers are often paired with a supplemental device (such as a conventional woofer or even subwoofer) that boosts the low-frequency output. Another problem relates to the localized way the vibration is introduced into the panel, where the axial pumping motion of an exciter produces a pinpoint-like disturbance pattern on the surface of the panel.

A need exists for transferring an audio signal to the panel by a process which does not limit power handling. An additional need exists for an improved panel and enclosure assembly that emphasizes panel excursion. There is also a need for a flat panel speaker that faithfully reproduces more of the nuances of an audio signal. There is also a need for a speaker structure that can be very compact and which can allow application versatility and cost saving.

SUMMARY OF THE INVENTION

These needs are met by the present invention, where one or more signal oscillation radiators (SORs) function as an exciter to transfer an audio signal to an acoustic panel TO reproduce high-quality audio frequencies on a flat panel speaker. The SOR, which transfers an audio signal to the panel by a process of oscillatory rather than translatory movement, allows for increased motion and power handling relative to a conventional axial exciter that produces a translational pumping movement. By the efficient oscillatory motion, the SORs are capable of providing both ample low frequency operation without sacrificing high frequency response; in fact, the present design is especially useful at reproducing low audio frequencies (such as below 100 Hz), where flat panel speakers have traditionally had difficulty. By using a partially fixed panel, the panel excursion potential is increased such that the range of motion of the SOR is not restrained. It will be appreciated that in the present context, the term "flat" in "flat panel speaker" encompasses not only completely flat speaker surfaces, but also those possessive of substantially planar features, as well as those within the accepted meaning of flat panel speakers.

According to an aspect of the present invention, a flat panel speaker includes a frame, a panel supported by the frame through a surround or related compliant structure, a conductor (such as speaker wire) to carry an audio signal from an audio source and one or more SORs signally coupled to the conductor. The one or more SORs are constructed such that they move in an oscillatory way in response to current changes in the audio signal. The panel is acoustically coupled to the one or more SORs such that SOR movement is imparted to the panel to cause it to vibrate, thereby producing sound.

Optionally, the acoustic coupling between the panel and one or more of the SORs is by direct mounting between them. In the present context, two components are directly mounted to one another when there is either contact between them (for example, where the components are touching one another and optionally secured together through fastening, adhesives, welding or the like), or involves a rigid mechanical coupling between them by way of their common connection to something else. In a particular configuration, the SOR may be made up of a coil former that includes a magnet-engaging portion, a magnet magnetically coupled to the magnet-engaging portion, and a coil winding signally coupled to the conductor. In a particular configuration, the magnet may be generally cylindrical such that its magnetic axis is defined along the magnet's substantially elongate dimension. In one form, the magnet-engaging portion may include a recess that is slightly oversized relative to the magnet, while in another, its outer dimension can be slightly smaller than an inner dimension of an aperture formed in the magnet. The coil winding is wrapped around the coil former in such a way that more than one sub-winding is produced, where the sub-windings can be formed from a continuous winding, or can be made from two separate coil windings. As is well-known in the electromagnetic arts, current loops established by each of these sub-windings can induce a magnetic field in a direction normal to the current flow. In the present invention, these sub-windings are placed laterally of the magnetic (i.e., north-south) axis of the magnet. This differs from the approach taken in solenoidbased configurations, where the winding (or windings) form a generally helical path around the magnetic axis. By having current loops in the form of sub-windings angled and placed adjacent the lateral sides of the magnet, a magnetic field induced by the current flowing through the sub-windings can bring to bear an oscillatory force between the magnet and the coil former. This oscillatory force can then be used to impart movement to either the magnet or the coil former, depending on which of the two was more compliantly (i.e., less rigidly) mounted. Thus, in a configuration where the magnet is rigidly affixed to a structure (such as to a pole piece that in turn is affixed to the speaker's frame or one of its subcomponents), the oscillatory force due to the fluctuating magnetic field may cause the coil former (rather than the magnet) to move; if the coil former is directly mounted to the panel of the speaker, the coil former movement is imparted to the panel for the reproduction of sound.

In another option, the magnet is directly mounted to the frame and the coil former is directly mounted to the panel such that a substantial entirety of movement produced by the oscillatory force is imparted to the panel through the coil former. The direct mounting of the magnet is a rigid mounting such that the magnet is substantially stationary, even under the force of oscillation. By such a rigid mounting, virtually all motion to the SOR as a result of the oscillatory force is imparted to the coil former. In a particular SOR configuration, the sub-windings cooperate to define a clamshell shape around the coil former such that a first of the sub-windings defines an upper clamshell and a second of the sub-windings defines a lower clamshell. A plane defined by the loops of the two clamshells is preferably angularly disposed relative to the magnetic axis of the magnet. In addition, a hinge axis defined by the common connection of the upper and lower clamshells is substantially aligned with a shorter dimension of the panel. In this way, oscillatory movement in the radiator is substantially aligned with a shorter dimension of the panel. Stated another way, an axis of oscillation in the coil winding is substantially parallel to the shorter of two planar axes formed in the surface of the panel.

In yet another option, the speaker includes numerous radiators. In one form, the speaker includes two SORs; in another, three. For example, a three-SOR configuration may includes a first radiator configured to oscillate within a first frequency range, a second radiator configured to oscillate within a second frequency range that is higher that of the first radiator, and a third radiator configured to oscillate at a third frequency range that is higher still. In one optional configuration, the magnet of the first radiator is directly mounted to the frame and the coil former of the first radiator is directly mounted to the panel such that a substantial entirety of movement produced by the oscillatory force on the first radiator is imparted to the panel through the former. As stated above, the rigid mounting of the magnet to the frame (or any such relatively immovable body) ensures that virtually all motion in the SOR is limited to the coil former. Preferably, the higher frequency second and third radiators are directly mounted to the panel. One or more sound couplers can be directly mounted to the panel to further enhance acoustic output.

In another aspect of the present invention, a signal oscillation radiator that can be used as an acoustic force driver for a flat panel speaker includes a magnet, a coil former and a coil winding signally coupled to the conductor and wrapped around the coil former in a manner such that a plurality of sub-windings are defined thereby, the sub-windings spaced relative to one another to define a clamshell shape around the coil former such that a first of the sub-windings defines an upper clamshell and a second of the sub-windings defines a lower clamshell, both the upper and lower clamshells angularly disposed relative to the magnetic axis such that a magnetic field induced by current flowing through the sub-windings induces an oscillatory force between the magnet and the coil former.

Optionally, the coil former can take on various constructions. For example, the coil former may be made to define a substantially cylindrical tubular construction around which the sub-windings are disposed. The magnet may define a substantially ring-like construction with an aperture sized to permit a portion of the coil former to extend through the aperture. The radiator may further comprise a pole piece magnetically coupled to the magnet, where the pole piece includes an extending or projecting member that extends through the aperture formed in the magnet and at least partially into the portion of the coil former that also extends through the magnet aperture. In one form, the sub-windings are at least partially longitudinally spaced relative to one another, while in another, they are laterally spaced relative to one another. In the present context, the longitudinal or lateral spacing between sub-windings pertains to how they are disposed relative not just to each other, but also how they are spaced relative to the axis of the coil former. Where the coil former is defined substantially by an elongate cylindrical tube, a lateral spacing would have one loop (i.e., sub-winding) surrounding one side of the outer dimension of the tube, while the other surrounds a generally opposite side of the tube's outer dimension. Contrarily, where the coil former is defined substantially by the same elongate cylindrical tube, a longitudinal spacing would have one loop disposed axially above or below the other loop. In cases of where the two loops are joined at a common region, the majority of the two loops would be axially spaced in a generally angular relationship. In either configuration, the aforementioned clamshell arrangement of the sub-windings is compatible with either the lateral or longitudinal spacing. In another form that is generally dissimilar to the ring-shaped form discussed above, the magnet defines a substantially cylindrical shape configured to fit within a tubular aperture formed in the coil former.

According to yet another aspect of the present invention, a method of producing sound in a flat panel speaker is disclosed. The method includes producing an audio signal, conveying the signal to a signal oscillating radiator, inducing a magnetic field in a portion of the radiator, and acoustically coupling the radiator to a speaker panel such that oscillatory motion induced in the radiator in response to the oscillatory force is imparted to the panel, causing it to vibrate. As previously discussed, the radiator includes a magnet, a coil former cooperative with the magnet, and a coil winding configured to accept the conveyed signal. Current that corresponds to the conveyed signal flows through the sub-windings, which by virtue of their positioning to one another and to the magnet, produce a magnetic field that cooperates with a magnetic field inherently formed about the magnet. This cooperation of magnetic fields induces an oscillatory force in the coil former that in turn induces the aforementioned vibratory motion in the panel. Optionally, the acoustic coupling between the speaker panel and the radiator comprises direct mounting between them. In another option, conveying the signal to the radiator comprises conveying a signal to numerous of radiators that operate within differing frequency ranges.

DETAILED DESCRIPTION OF THE PREFERRED EMBODIMENTS

Figure 1A:
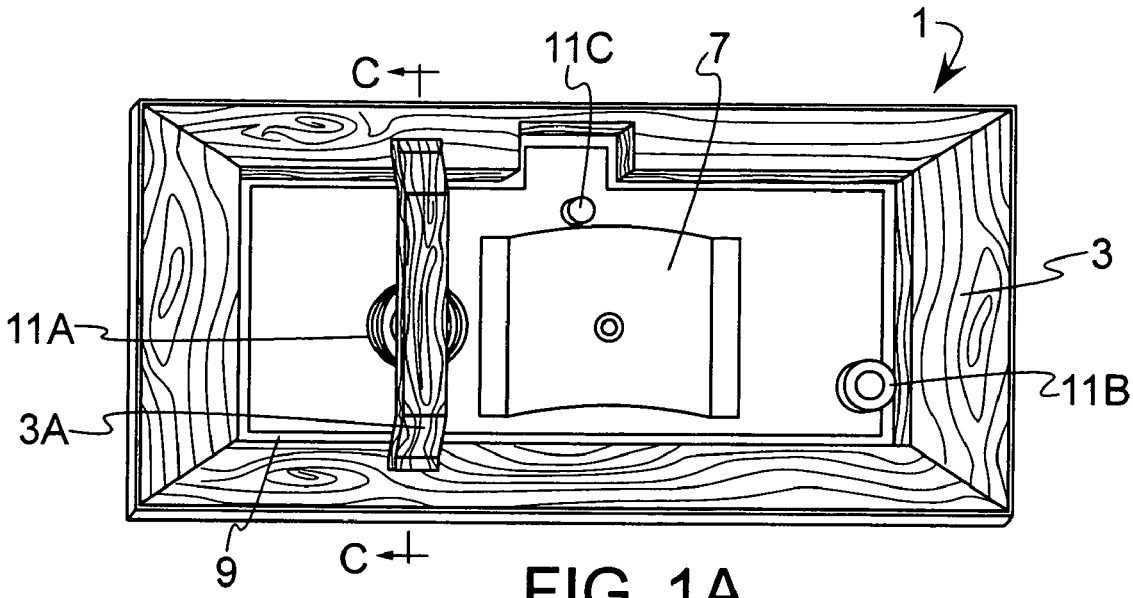
FIG. 1A is a rear view of a flat panel speaker according to an embodiment of the present invention.
Figure 1B:
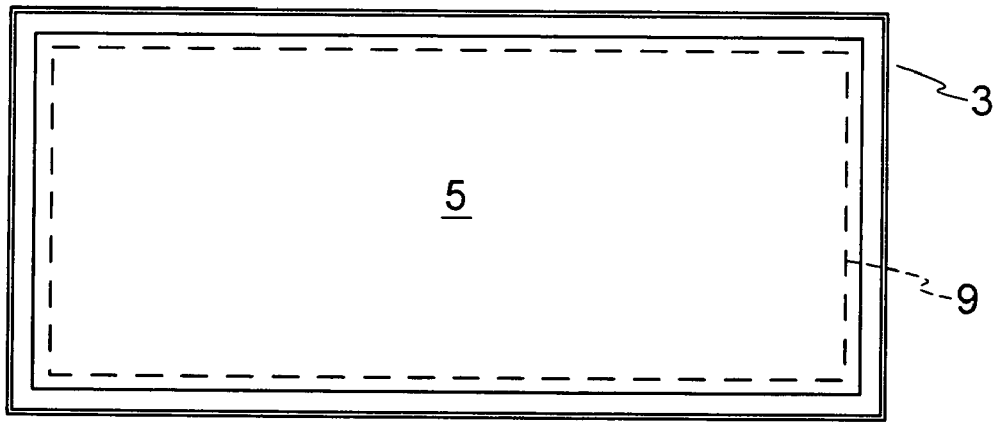
FIG. 1B is a front view of the speaker of FIG. 1.
Figure 1C:
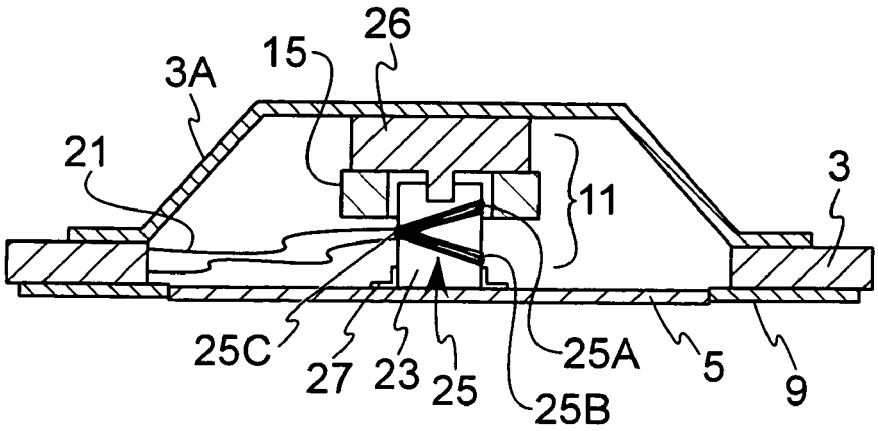
FIG. 1C is an edge view of the speaker of FIG. 1, taken along lines C-C thereof, where for the purpose of the drawing the SOR has been rotated about a vertical axis to better show the clamshell construction of the coil winding.

Referring first to FIGS. 1A through 1C, details of the present invention flat panel speaker are shown. Referring with particularity to FIG. 1A, a reverse view of speaker 1 is shown, with a rear cover removed to highlight speaker details. Frame 3 acts as the primary structural member for panel 5 (also referred to as a diaphragm). SORs 11, individually shown as low frequency SOR 11A, midrange (also called mid frequency) SOR 11B and high frequency SOR 11C, are used to drive the panel 5 with oscillating vibrations that correspond to an audio signal. Frame 3 and panel 5 define a generally rectangular shape for speaker 1, with a widthwise dimension that is less than a heightwise dimension. A sound coupler 7, which is preferably made of thin, flexible material (such as poster board) and shaped in the form of a tubular conic section, is mounted to the panel 5 to augment sound. The dimensions of the sound coupler 7 can be tailored to specific frequencies. For example, the sound coupler 7 is used to enhance frequency response in the range of 750 to 800 Hz, thereby improving mid frequency response. The sound coupler 7 amplifies mechanical vibrations which are gathered and amplified inside its tubular section. In the embodiment depicted in FIG. 1A, the sound coupler 7 is placed in the region of panel 5 located near the low frequency and midrange SORs 11A, 11B to increase response of these respective frequencies.

In the embodiment shown in FIG. 1A, low frequency SOR 11A, midrange SOR 11B and high frequency SOR 11C are all mounted directly to the panel 5, where placement of the low frequency SOR 11A near the lower region of the panel 5 promotes maximum bass response. Conductive wire 21 (also referred to simply as a conductor) is used to transmit electrical current that corresponds to signals from an audio source such as a radio, sound system, receiver, musical instrument amplifier or the like (none of which are shown). In one common form, conductor 21 is made from conventional speaker wire. A crossover network (not shown) allocates to the various SORs 11A, 11B, 11C the appropriate frequency range of signals to promote optimum acoustic response. The figure also shows an example of approximate preferential locations for SORs 11A, 11B, 11C. The inventor has determined that while it is permissible to have the high frequency SOR 11C oscillate along a dimension parallel to that of the other SORs, high frequency response is optimized when the high frequency SOR 11C is not coaxial with the others. Referring with particularity to FIG. 1B, the obverse side of speaker 1 is shown, where panel 5 occupies the majority of the area formed within frame 3. Placement of surround 9 between panel 5 and frame 3 promotes the enhanced level of vibration isolation.

Referring with particularity to FIG. 1C, elevated cross member 3A forms part of frame 3, and can be used as a mounting structure for low frequency SOR 11A. The direct mounting of a portion of the low frequency SOR 11A to the cross member 3A of frame 3 inhibits movement of the components within that portion, thereby forcing other components to move in response to changing magnetic fields. It will be appreciated by those skilled in the art that the placement of low frequency SOR 11A, cross member 3A and other components need not be precisely as shown, and that other locations based on the need to optimize certain audio signals are within the scope of the present invention. Panel 5 is connected to frame 3 through a surround 9, which is also used to isolate vibrations of panel 5 from the frame 3 and the remainder of speaker 1. Surround 9 is made from a generally compliant material, such as foam, to promote the absorption of vibrations. The compliant nature of the surround 9 at the outer edge of the panel 5 permits the panel 5 to have an increased range of motion as the low frequency SOR 11A induces it to vibrate. Additionally, the surround 9 allows the panel 5 to remain isolated from frame 3, thereby reducing or eliminates unwanted resonance. Other than the rectangular shape shown, the surround 9 can be configured in a manner generally similar to that of surrounds for conventional cone speakers. The present figure also shows a generally rectangular-shaped cutout in frame 3. High frequency SOR 11C can be placed adjacent (as shown) or within the region defined by the cutout. It will be appreciated by those skilled in the art that separate regions such as the generally rectangular cutout formed in the frame 3 are not necessary, and that a conventional rectangular frame (not shown) could be used as well.

Figure 2:
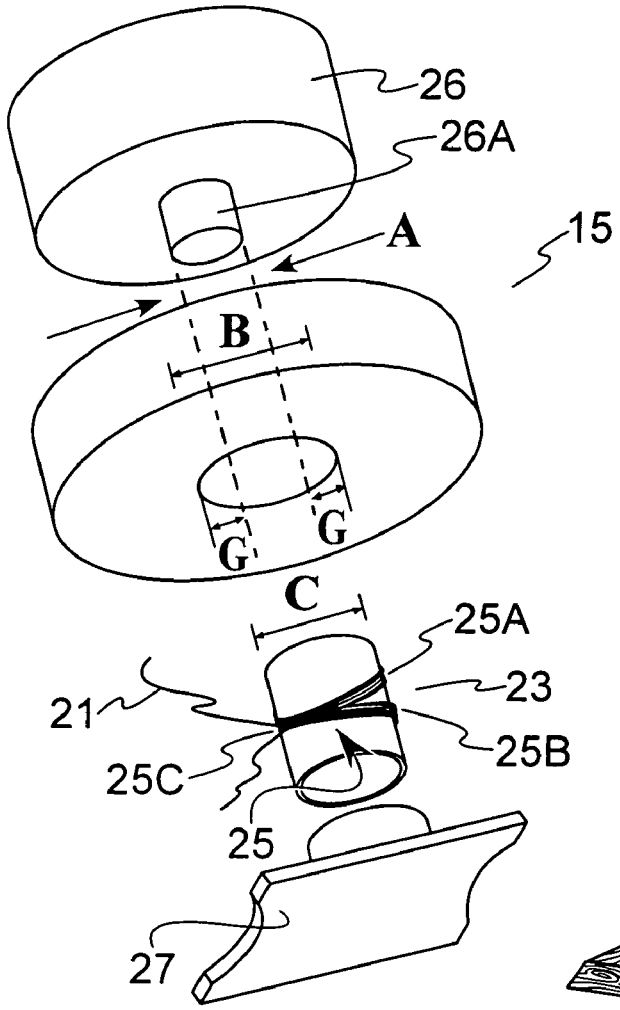
FIG. 2 shows an exploded view of a first embodiment of a low frequency SOR, showing the clamshell coil winding used to produce oscillatory SOR motion.

Referring next to FIG. 2, details of the construction of one embodiment of the low frequency SOR 11A is shown. One portion of the low frequency SOR 11A is rigidly mounted to the frame via bridge-shaped cross-member 3A, while another portion is mounted directly to the panel 5. Low frequency SOR 1A includes a magnet 15, coil former 23, conductor 21 wound around the coil former 23 in a predetermined pattern to produce coil winding 25, and pole piece 26 with extending member 26A that can help define and strengthen the distribution of the magnetic field in the surrounding area. The coil winding 25 can be bifurcated into two separate sub-windings 25A, 25B that will be discussed in more detail below. The production of multiple sub-windings can result from either the clamshell-shaped configuration discussed below, or from two separate sets of wound coils. In the first configuration, a hinge 25C is common to both sub-windings as the location where wire from both loops are overlapped. In the second configuration, the sub-windings 25A, 25B may be wound in a layered fashion to produce concentric windings. In this second configuration, there is no hinge per se, but rather a common location where the individual wires from each loop overlap in a manner generally similar to that of the first configuration. This second approach may be beneficial in producing the necessary impedance levels for matching. It will be appreciated by those skilled in the art that either the hinged or separate constructions can be employed in the present invention.

The uppermost portion of the pole piece 26 is generally planar, thereby facilitating attachment to a complementary lower surface of cross-member 3A. Conventional joining approaches, including adhesives or fasteners, may be used. The dimension A represents the outer diameter on the extending member 26A of pole piece 26, while dimension B represents the inner diameter of a central aperture in the doughnut-shaped magnet 15, and dimension C represents the inner diameter of coil former 23. Magnet 15 forms a strong bond with pole piece 26 when the latter is made from a magnetic material (such as iron). Their joining results in the formation of an annular gap G between the inner surface of magnet 15 and the outer surface of the extending member 26A. The upper edge of tubular-shaped coil former 23 can be fitted within gap G, thereby defining a nesting relationship with pole piece of outer dimension A fitting within coil former 23 of dimension C, both of which fit within the aperture of magnet 15 with inner dimension B. This arrangement is sufficient to allow oscillatory excursions produced in the low frequency SOR 11A to be transferred to the coil former 23, which by virtue of its direct mounting to flexible panel 5, transfers the oscillatory motion into sound. By contrast, the magnet 15, by virtue of its rigid mounting to the substantially immovable cross member 3A of frame 3 as shown in FIG. 1C, will remain substantially stationary, even when the fluctuating magnetic fields are producing oscillatory forces in low frequency SOR 11A. The lower edge of coil former 23 may include a collar or flanged sleeve 27 that can form a base with which to secure coil former 23 to panel 5. Conventional attachment schemes, such as fastening or adhesive bonding, may be used to secure the flanged sleeve 27 to the panel 5. As constructed low frequency SOR 11A produces an oscillating (side-to-side) motion across the coil former 23 in response to current flowing through coil winding 25, which is in turn transferred to panel 5. This motion is significantly different than the translational (back-and-forth) motion associated with conventional dynamic (cone) speakers, as well as the translational movement imparted to a panel by an axial exciter in a conventional flat panel speaker, which have a difficult time faithfully reproducing both the rapid fluctuations associated with high frequency sound reproduction and the large excursions associated with low frequency sound reproduction.

Figure 3:
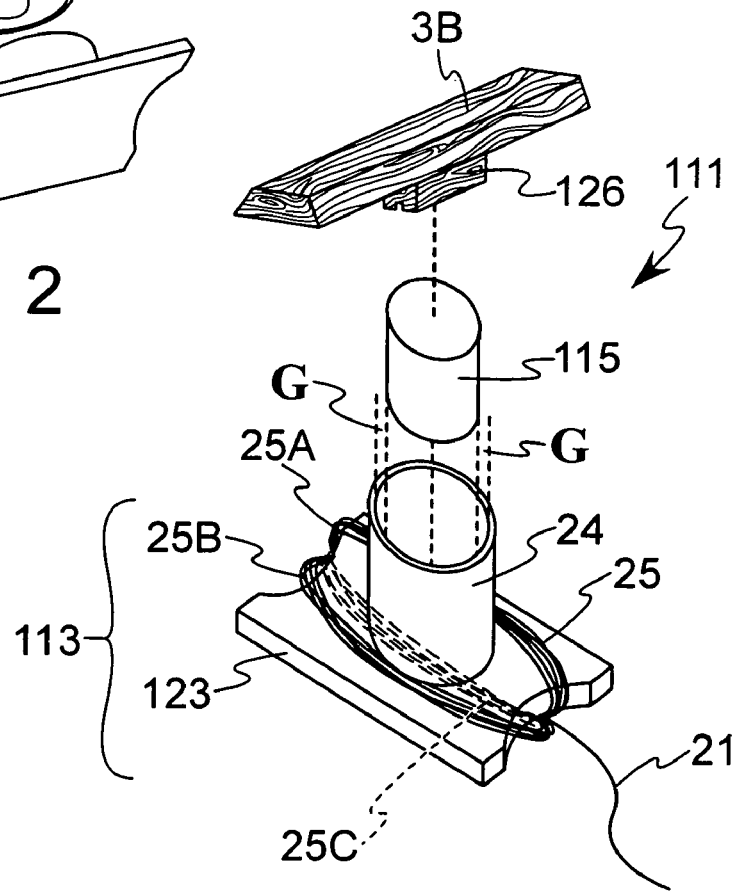
FIG. 3 shows an exploded view of an alternate embodiment low frequency SOR.
Figure 6:
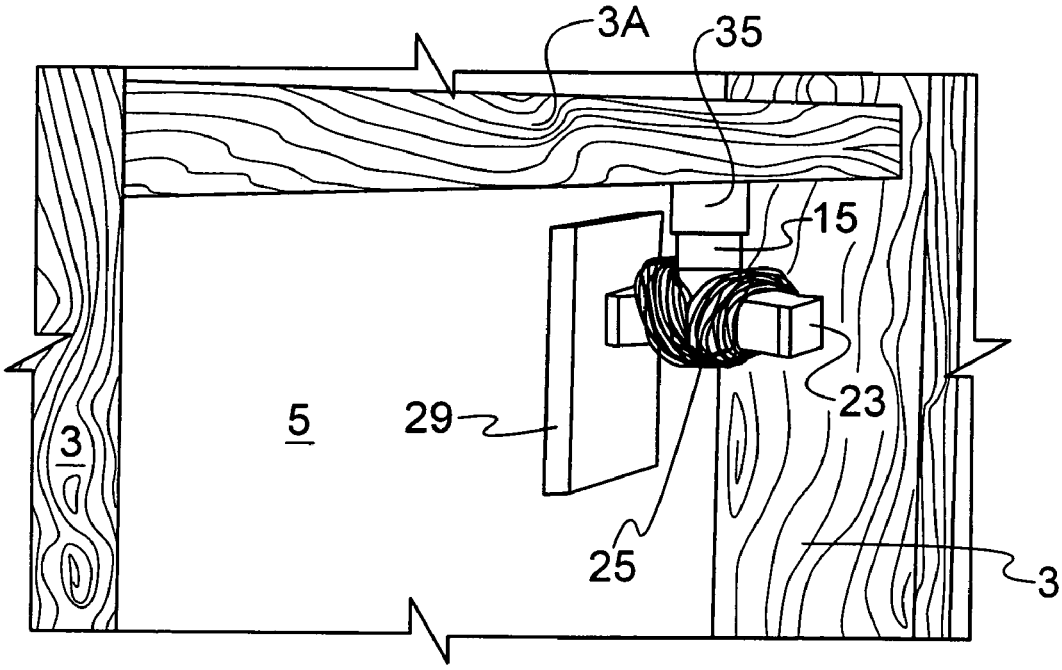
FIG. 6 shows a rear angular view of the low frequency SOR of FIG. 3, where the magnet is mounted to a cross member portion of the frame and the coil former is mounted to the panel.

Referring next to FIGS. 3 and 6, details of an alternate embodiment of the low frequency SOR 11A and its placement relative to the frame 3 of speaker 1 are shown. Unlike the embodiment shown in FIG. 2, the low frequency SOR 11A of the present embodiment is rigidly mounted to the frame via cross-member 3A, rather than directly to the panel 5. Referring with particularity to FIG. 3, low frequency SOR 11 includes a drive unit 13 and magnet 15. Drive unit 13 is made up of a coil former 23 with a magnet-engaging portion 24 (presently shown in FIG. 3 in the form of an integrally-formed recess). Drive unit 13 also includes the clamshell-shaped coil winding 25 of the previous embodiment. An annular gap G between the outer surface of magnet 15 and the inner surface of the magnet-engaging portion 24 is sufficient to allow oscillatory excursions in the low frequency SOR 11A to be transferred to the coil former 23 in a manner generally analogous to that of the embodiment depicted in FIG. 2. Also as with the embodiment depicted in FIG. 2, the magnet 15, by virtue of its rigid mounting to the substantially immovable cross member 3A of frame 3, will remain substantially stationary, even when the fluctuating magnetic fields are producing oscillatory forces in low frequency SOR 11A. In addition to coil former 23 with magnet-engaging portion 24 and magnet 15 and coil winding 25, low frequency SOR 11A may include a pole piece 26 that can help define and strengthen the distribution of the magnetic field in the surrounding area. Pole piece 26 may be shaped to promote the desired magnetic field. Additional magnets (not shown) may also be used to increase the field size.

Referring with particularity to FIG. 6, the direct mounting of the magnet 15 to the cross member 3A of frame 3 is shown. Also, the direct mounting of the coil former 23 to panel 5 is shown. Since the panel 5 is more flexible than the cross member 3A, virtually all motion produced in low frequency SOR 11 is transferred to the panel 5 through the coil former 23. Although magnet 15 is presently shown as fitting into cup 35 (which is in turn secured to cross member 3A), it will be appreciated by those skilled in the art that pole piece 26 (shown in FIG. 3) could be placed between the magnet 15 and cross member 3A, and as long as rigidly secured to both, will not move in response to the fluctuating magnetic fields produced in winding 25. The low frequency SOR 11A is joined to the panel 5 at a 90° angle as shown, where the drive unit 13 may be first bonded to a stiff mass 29 that is in turn joined to the panel. This mounting process helps the low frequency SOR 11A to deliver low frequency oscillation to panel 5.

Figure 4A:
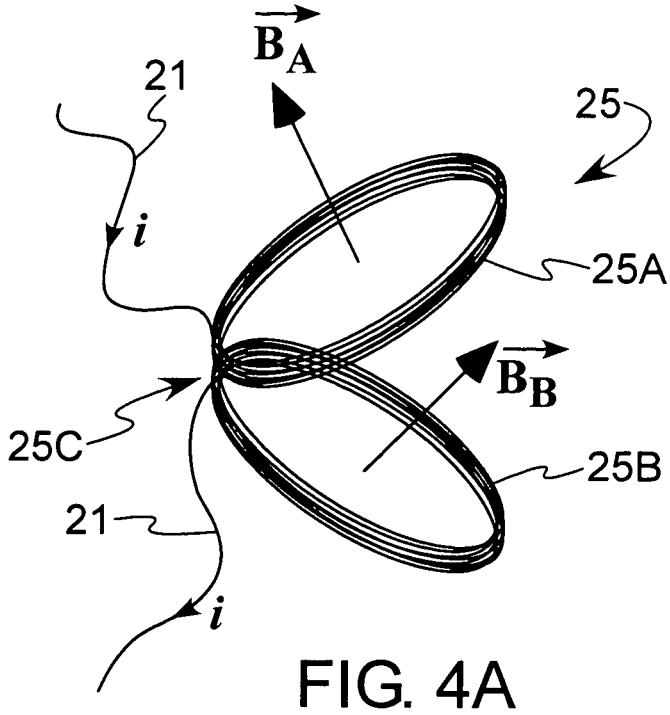
FIG. 4A shows the clamshell coil winding formed from a pair of sub-windings, where the coil winding is useable in the low frequency SORs of either FIG. 2 or FIG. 3.
Figure 4B:
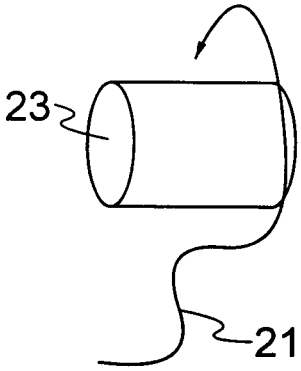
FIGS. 4B through 4E depict steps in producing the clamshell-shaped coil winding of the SOR of FIG. 2.
Figure 4C:
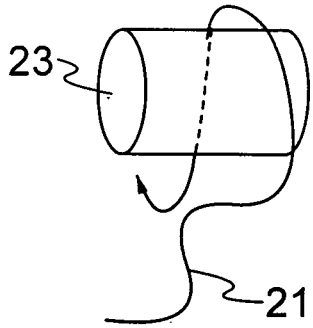
Figure 4D:
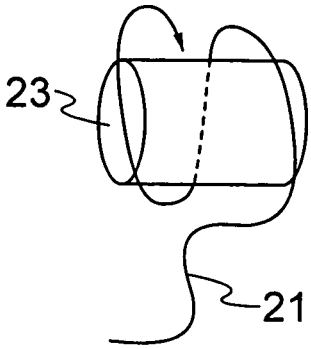
Figure 4E:
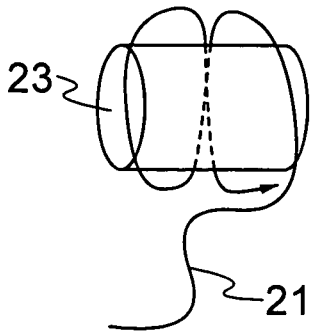

Referring next to FIGS. 4A through 4E, a coil winding 25 and accompanying technique used for producing the coil winding 25 of the embodiment depicted in FIG. 2 is shown, although it will be appreciated that the winding steps are also applicable to the embodiment of FIG. 3. In FIG. 4B, the starting position takes conductor 21 and winds it up and along the right front side of the coil former 23, after which it is looped over the coil former 23 top. In FIG. 4C, once the conductor 21 is looped over the top of the coil former 23, it is brought down the middle of the back side of the coil former 23 and looped underneath and forward of the bottom. In FIG. 4D, conductor 21 is continued up and along the left front side of the coil former 23 and over its top in a substantially mirror-image way to that of FIG. 4B. In FIG. 4E, the conductor 21 is continued down the middle of the back side of the coil former 23 and looped underneath and forward of the bottom to the position shown in FIG. 4B. These steps are repeated until the necessary number of windings are achieved. This produces a coil winding 25 continuously in a crossing V-like manner below the coil former 23 adjacent the bottom of magnet 15 (not presently shown).

Referring with particularity to FIG. 4A, the V-like construction results in a clamshell configuration, where upper and lower sub-windings 25A, 25B (also referred to as loops) are formed, with hinge 25C defining the vee or apex. It will be appreciated that the naming convention designating upper and lower loops is strictly arbitrary, as they could have just as easily been designated "right" and "left" or the like. Referring again to FIG. 3 in conjunction with FIG. 4E, this allows the magnetic axis of magnet 15 to be placed extending away from the hinge 25C at the apex of the clamshell and between the sub-windings 25A, 25B. Compared to a conventional winding approach (where a solenoid-like helical winding is oriented such that an induced magnetic field produced by the passage of electrical current extends in a single direction), the clamshell-like sub-windings 25A and 25B and their angled placement relative to the magnetic axis of magnet 15 exert a fluctuating, side-to-side motion in the magnet 15, which acts to reinforce the tendency of the magnet 15 to move in response to an imposed current flow. In situations where the magnet 15 is spatially fixed, such as that shown by the mounting configuration in FIG. 3, it is the remainder of the low frequency SOR 11, especially the coil former 23, that must move.

Figure 5A:
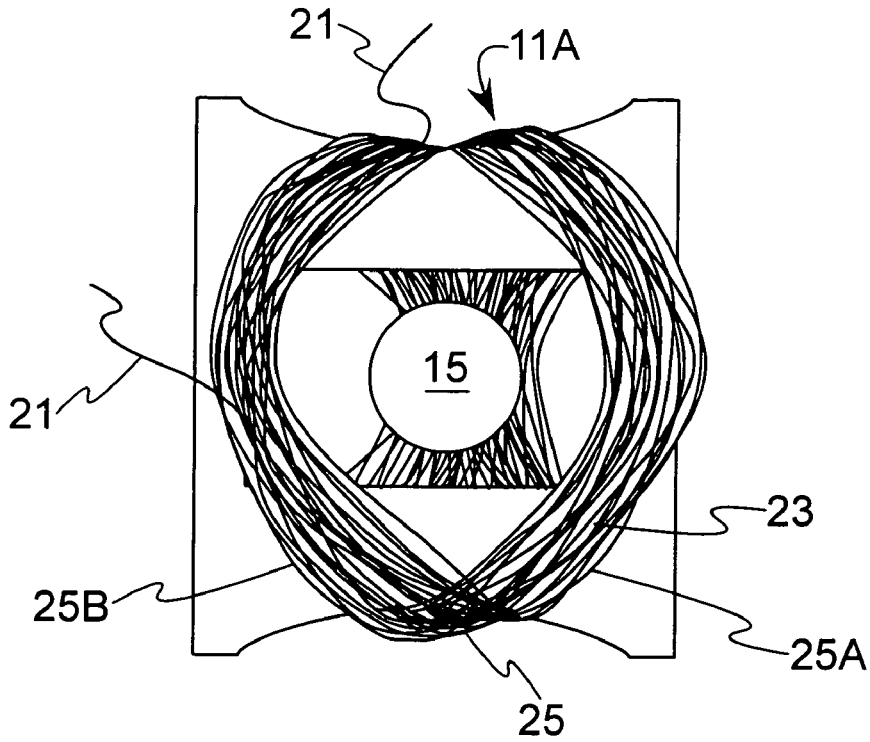
FIG. 5A shows a representative placement of a magnet into a simplified SOR where no current is passing through the coil winding.
Figure 5B:
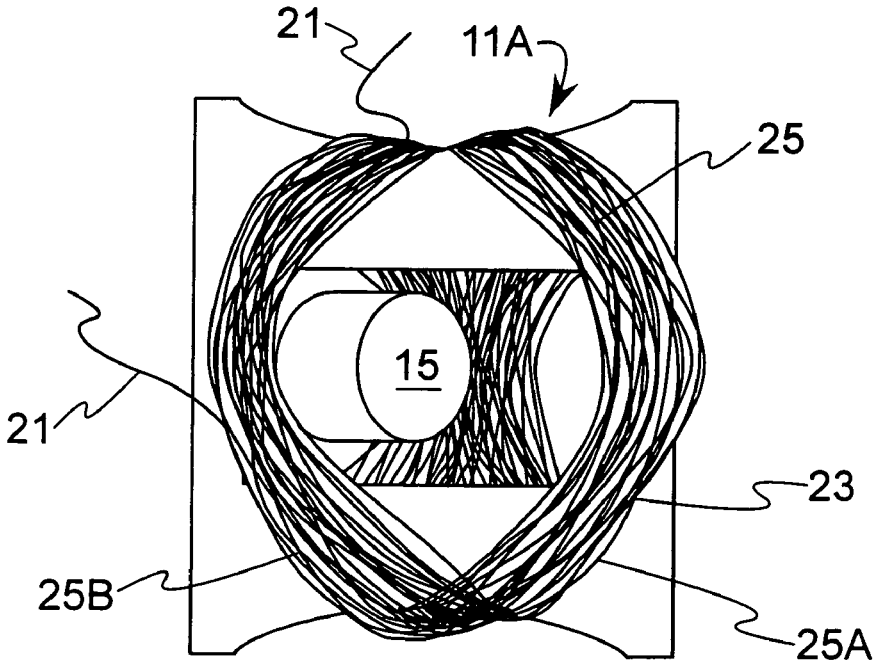
FIG. 5B shows the SOR of FIG. 5 when a positive current is passing therethrough.
Figure 5C:
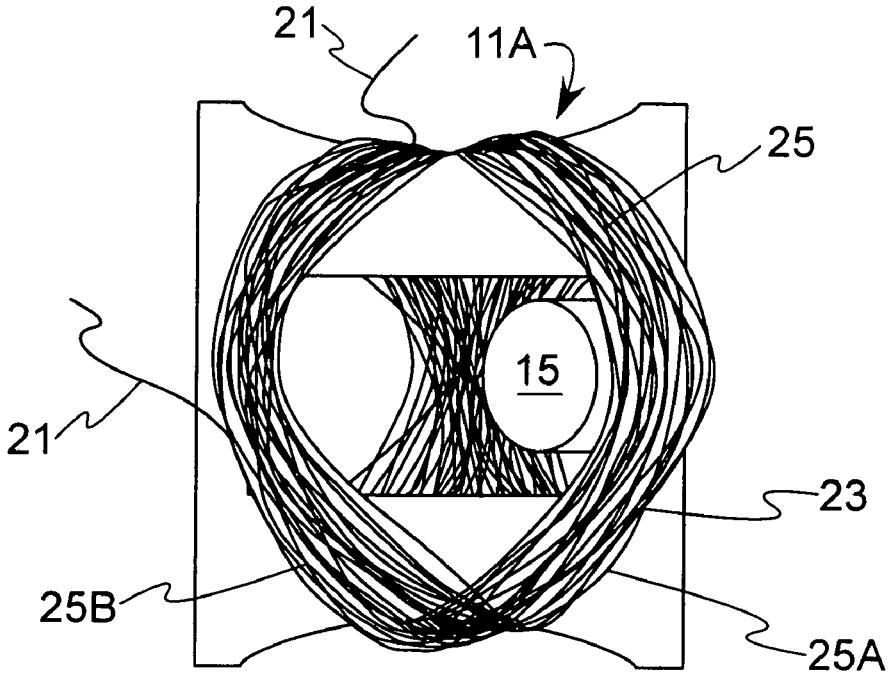
FIG. 5C shows the SOR of FIG. 5 when a negative current is passing therethrough.

Referring next to FIGS. 5A through 5C, an unsecured magnet 15 placed in coil winding 25 is used to highlight an example of oscillatory movement in response to changing current flow. With no current flowing through coil winding 25, the magnet 15 rests in the neutral position centered between the two sub-windings 25A and 25B, as shown in FIG. 5A. Referring next to FIGS. 5B and 5C, the coil winding 25, when energized by an audio signal from the audio source, produces an oscillating motion, where the coil winding 25, when energized with a positive current, induces magnet 15 to bias to the left side of the coil former 23, while energizing the coil winding 25 with a negative current induced the magnet 15 to bias to the right side of the coil former 23. In the present figures, it is the unsecured magnet 15 that is oscillating; when the magnet 15 is grounded to the frame 3 in the manners shown in FIGS. 1C and 3, it is the coil former 23, 123 (of FIGS. 1C and 3, respectively), which is adjoined to the panel 5, that must move. By this construction, the repeated side-to-side oscillating motion of magnet 15 within the coil winding 25 transfers the audio signal from the low frequency SOR 11 to resonate across the entire panel 5. The greater the magnitude of the oscillating motion, the greater the resulting bending resonances which are transferred to the panel 5. These greater level of bending resonances in turn allow the reproduction of low frequency (such as low-end bass) response.

Figure 7:
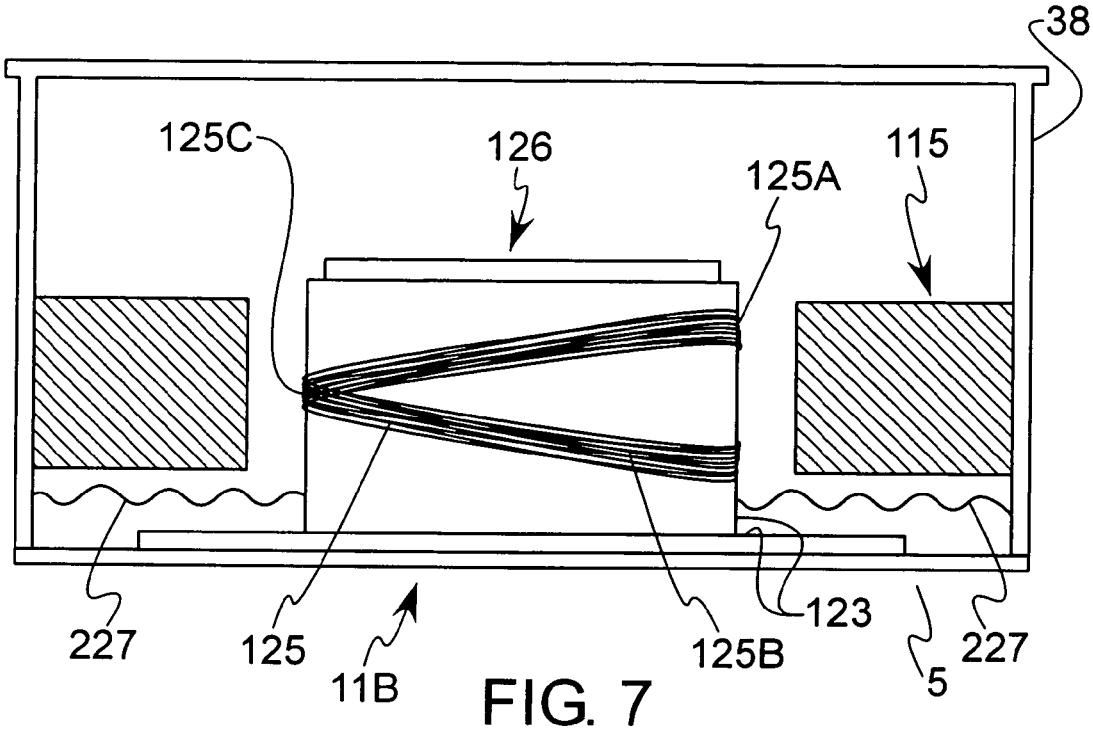
FIG. 7 shows a midrange frequency SOR mounted to the panel.
Figure 8:
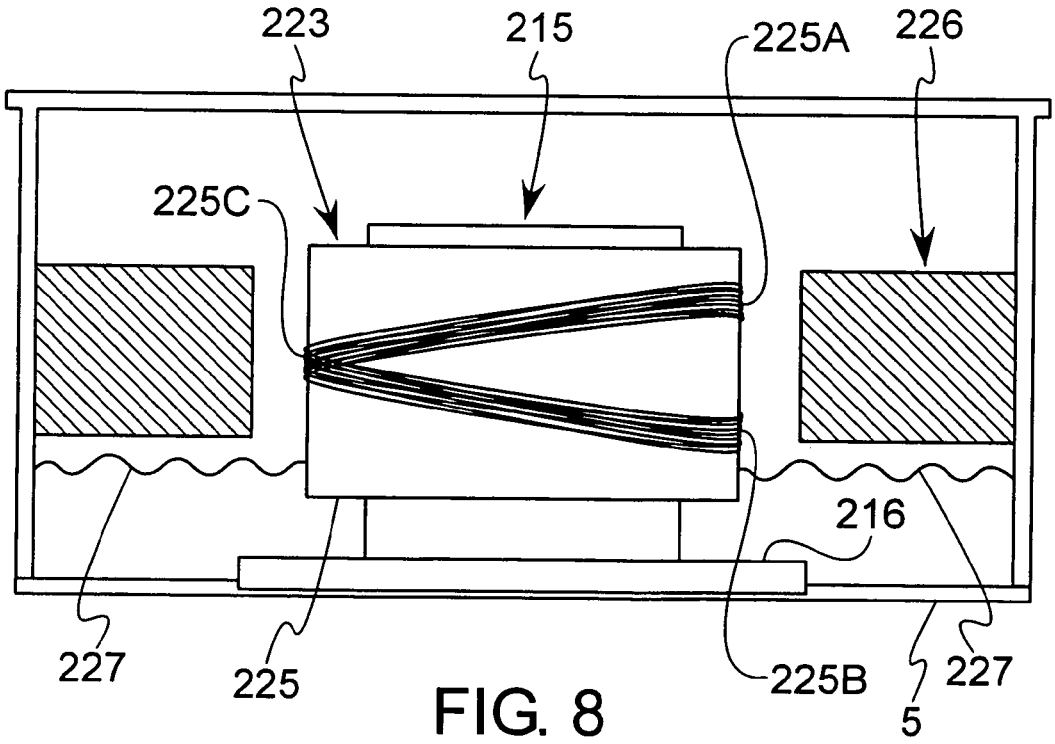
FIG. 8 shows a high frequency SOR mounted to the panel.

Referring next to FIGS. 7 and 8, a similar process can be used to produce SORs for other frequency ranges (such as high and mid-range audio frequencies), with appropriately smaller dimensions, wound to relatively smaller impedance values. Referring with particularity to FIG. 7, the midrange SOR 11B includes a coil former 123, coil winding 125 with sub-windings 125A, 125B joined at hinge 125C, as well as magnet 115. As discussed above, in place of the single coil winding 25 with continuous sub-windings 25A, 25B coming together to produce hinge 25C that was used in the low frequency SOR 11A, separate coil windings 125 can be formed such that at a common point, one loop can overlap the other. To be responsive to the higher frequencies associated with midrange audio signals, the size of midrange SOR 11B is smaller than its low frequency counterpart 11A. Besides the size, the fundamental difference between the midrange SOR 11B and the low frequency SOR 11A is placement and shape of the tubular-shaped former 123, magnet 115 and pole piece 126. As with the previous embodiment, when an electrical current pass through the coil 125, it creates a magnetic field that interacts with the fixed field of the magnet 115, causing the coil former 123 to oscillate against panel 5.

Referring next to FIG. 8, the high frequency SOR 11C is shown coupled to panel 5. As with the midrange SOR 11B, the high frequency SOR 11C is attached to panel 5 at a 90° angle. As with the midrange SOR 11B, the high frequency SOR 11C, the fundamental difference is the way the magnet 215, coil winding 225 and coil former 223 and pole piece 226 are mounted onto the panel 5. In the high frequency SOR 11C, one side of the magnet 215 is connected to a ring-shaped metal member 216, where the magnetic properties of the magnet 215 and the member 216 are such that the two are held together by the magnetic force of the magnet 215. Together, these are joined to the panel 5. Coil former 223 is placed over the unattached end of the magnet 215 with the magnet 215 centered as shown. This mounting process facilitates oscillatory coupling of the high frequency SOR 11C to panel 5. In addition to pole piece 226 (which is placed concentrically around the magnet 215 coil former 223 and coil winding 225), a spider suspension 227 can be used to hold the coil winding 225 and magnet 215 in place. In another embodiment, the entirety of the midrange and high frequency SORs 11B, 11C can be each configured as self-contained units such that they can be directly mounted to panel 5 without the need for intervening structure to hold the magnet, pole piece or coil former.

Figure 9:
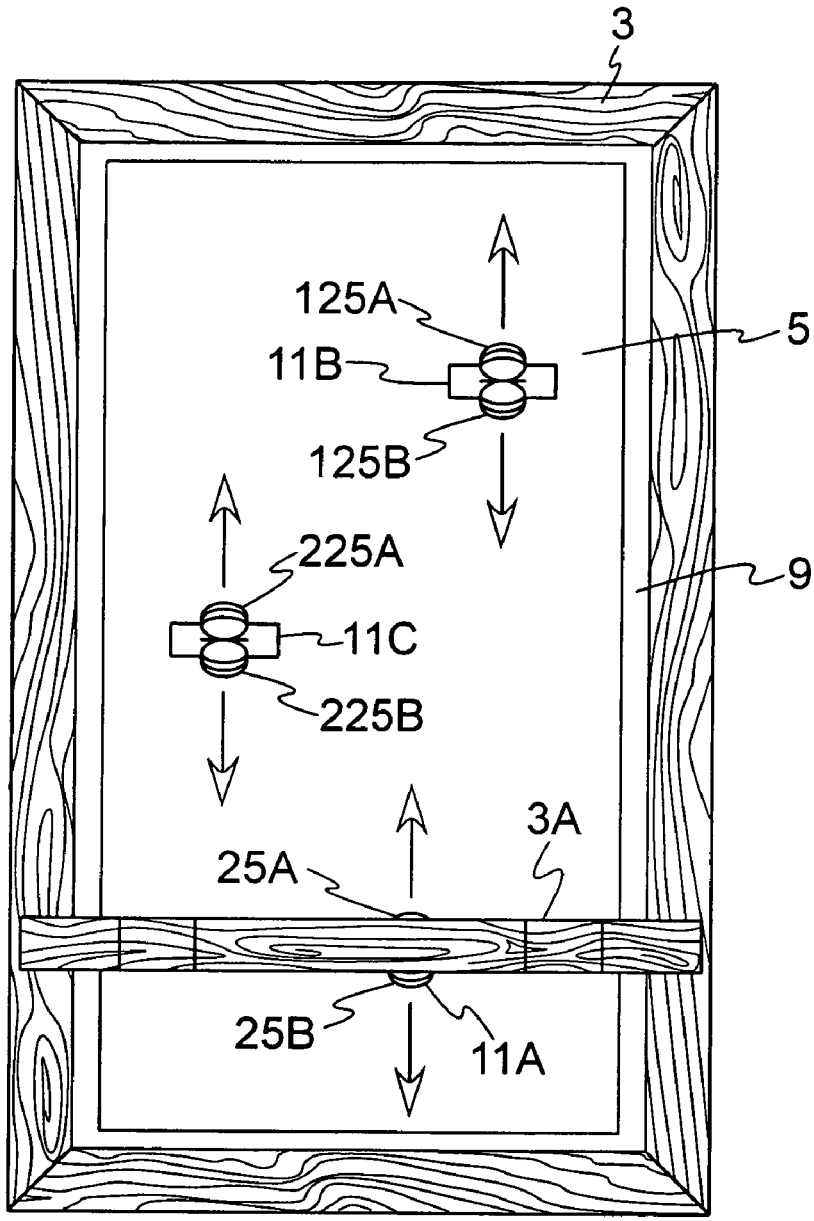
FIG. 9 shows the axis of oscillation of the coil winding of each of the SORs is substantially parallel to the shorter widthwise panel axis, while the direction of oscillation is substantially parallel to the longer heightwise axis.
Figure 9A:
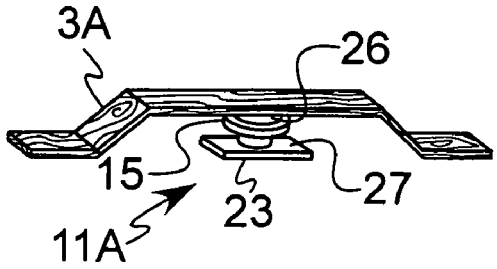
FIG. 9A shows an angled view of the attachment of the low frequency SOR to the cross member for the embodiment of FIG. 9.

Referring next to FIGS. 9 and 9A, a representation of the orientation of the SORs 11A, 11B and 11C placed on a flat panel speaker according to an aspect of the present invention is shown. As shown, the arrows indicate the path of oscillation of the various SORs, where the axis about which the oscillation takes place extends along the shorter of the speaker's two rectangular dimensions. The side-to-side oscillating motion, which is characteristic of the SOR design, allows for signals to be more defined and concentrated in a linear path. By this design, the panel can be divided into frequency regions based upon placement of the low frequency, midrange and high frequency SORs 11A, 11B and 11C. This allows for frequencies to be isolated on different regions of the panel 5. A particular example of this is shown in FIG. 1A, where the high frequency SOR 11C is placed in a separate location within panel 5. Additionally, this allows for more accurate and precise reproduction of bass, midrange, and high frequencies because signals reproduced by the SORs 11A, 11B and 11C are not dissipated in all directions on the panel, but rather are isolated linearly in their perspective regions. With the placement of the low, midrange and high frequency SORs 11A, 11B and 11C in different regions of the panel, full surface area signal dissipation can be promoted. As shown, the end of low frequency SOR 11A corresponding to the pole piece 26 is suspended from cross member 3A. Although panel 5 is shown with SORs that correspond to three frequency ranges of audio interest, it will be appreciated by those skilled in the art that more discrete ranges of acoustic response panels can be devised with any of the previously discussed SORS. For example, a bass panel can be achieved by the placement of a single low frequency SOR 11A on a panel to reproduce low audio signals which are commonly reproduced by the use of a subwoofer standard home audio applications.

While certain representative embodiments and details have been shown for purposes of illustrating the invention, it will be apparent to those skilled in the art that various changes may be made without departing from the scope of the invention, which is defined in the appended claims.

What is claimed is:

1. A flat panel speaker comprising:

a conductor configured to convey current representative of an audio signal from an audio source;

at least one signal oscillation radiator signally coupled to said conductor such that said at least one radiator is responsive to said current, said at least one radiator comprises a first radiator configured to oscillate at a first frequency range in response to said current, said first radiator comprising:

a magnet defining a magnetic field axis thereby;

a coil former defining a magnet-engaging portion; and a coil winding signally coupled to said conductor and wrapped around said coil former in a manner such that a plurality of sub-windings are defined thereby, said sub-windings spaced relative to one another to define a clamshell shape around said coil former such that a first of said sub-windings defines an upper clamshell and a second of said sub-windings defines a lower clamshell, both said upper and lower clamshells angularly disposed relative to said magnetic axis such that a magnetic field induced by current flowing through said sub-windings induces an oscillatory force between said magnet and said coil former;

a panel acoustically coupled to said at least one radiator such that oscillatory motion induced into said at least one radiator in response to receipt of said current is imparted to said panel to cause vibration thereof;

a frame to support said panel; and a surround disposed intermediate said frame and said panel and configured to at least partially decouple vibrations therebetween.

2. The speaker of claim 1, wherein said acoustic coupling between said panel and said at least one radiator comprises direct mounting between them.

3. The speaker of claim 1, wherein said coil former defines a substantially cylindrical tubular construction, and wherein said magnet defines a substantially ring-shaped construction with an aperture dimension defined therein that permits a portion of said coil former to extend therethrough.

4. The speaker of claim 3, further comprising a pole piece magnetically coupled to said magnet, said pole piece comprising an extending member configured to extend through said aperture formed in said magnet and at least partially into said portion of said coil former that extends through said aperture defined in said magnet.

5. The speaker of claim 1, wherein said magnet is directly mounted to said frame and said coil former is directly mounted to said panel such that a substantial entirety of movement produced by said oscillatory force is imparted to said panel through said coil former.

6. The speaker of claim 1, wherein a hinge axis defined by connection of said upper and lower clamshells is substantially aligned with a shorter dimension of said panel such that oscillatory movement in said radiator is substantially aligned with a longer dimension of said panel.

7. The speaker of claim 1, wherein said at least one radiator comprises said first radiator and at least one additional radiator.

8. The speaker of claim 7, wherein said at least one additional radiator comprises:

a second radiator configured to oscillate at a second frequency range in response to said current, said second frequency range being higher than said first frequency range; and a third radiator configured to oscillate at a third frequency range in response to said current, said third frequency range being higher than said second frequency range.

9. The speaker of claim 8, wherein at least a portion of said second and third radiators are directly mounted to said panel.

10. The speaker of claim 9, wherein the entirety of said second and third radiators are directly mounted to said panel.

11. The speaker of claim 1, further comprising a sound coupler directly mounted to said panel.

12. A signal oscillation radiator configured to provide an acoustic force to a flat panel speaker, said radiator comprising:

a magnet defining a magnetic field axis thereby;

a coil former; and a coil winding signally coupled to a conductor and wrapped around said coil former in a manner such that a plurality of sub-windings are defined thereby, said sub-windings spaced relative to one another to define a clamshell shape around said coil former such that a first of said sub-windings defines an upper clamshell and a second of said sub-windings defines a lower clamshell, both said upper and lower clamshells angularly disposed relative to said magnetic axis such that a magnetic field induced by current flowing through said sub-windings induces an oscillatory force between said magnet and said coil former.

13. The radiator of claim 12, wherein said coil former defines a substantially cylindrical tubular construction around which said sub-windings are disposed.

14. The radiator of claim 13, wherein said magnet defines a substantially ring-shaped construction with an aperture dimension defined therein that permits a portion of said coil former to extend therethrough.

15. The radiator of claim 14, further comprising a pole piece magnetically coupled to said magnet, said pole piece comprising an extending member configured to extend through said aperture formed in said magnet and at least partially into said portion of said coil former that extends through said aperture defined in said magnet.

16. The radiator of claim 15, wherein said sub-windings are at least partially longitudinally spaced relative to one another.

17. The radiator of claim 13, wherein said sub-windings are laterally spaced relative to one another.

18. The radiator of claim 17, wherein said magnet defines a substantially cylindrical shape configured to fit within a tubular aperture formed in said coil former.

19. A method of producing sound in a flat panel speaker, said method comprising:

producing an audio signal;

conveying said signal to a signal oscillating radiator, said radiator comprising:

a magnet;

a coil former cooperative with said magnet; and a coil winding configured to accept said conveyed signal, said winding wrapped around said coil former in a manner such that a plurality of sub-windings are defined thereby, said sub-windings spaced relative to one another to define a clamshell shape around said coil former such that a first of said sub-windings defines an upper clamshell and a second of said sub-windings defines a lower clamshell, both said upper and lower clamshells angularly disposed relative to a magnetic axis;

inducing a magnetic field adjacent said sub-windings by a current flow therethrough that corresponds to said conveyed signal, said induced magnetic field cooperating with a magnetic field formed in said magnet such that together, said magnetic fields induce an oscillatory force in said coil former; and acoustically coupling said radiator to a speaker panel such that oscillatory motion induced into said radiator in response to said oscillatory force is imparted to said panel to cause vibration thereof.

20. The method of claim 19, wherein said acoustic coupling between said speaker panel and said radiator comprises direct mounting between them.

21. The method of claim 19, wherein said conveying a signal to said radiator comprises conveying a signal to plurality of radiators comprising a first radiator configured to oscillate within a first frequency range and at least one additional radiator configured to oscillate at a second frequency range higher than said first frequency range.

22. The method of claim 21, wherein said at least one additional radiator configured to oscillate at a second frequency range higher than said first frequency range further comprises a third radiator configured to oscillate at a third frequency range higher than said first and second frequency ranges.

* * * * *

UNITED STATES PATENT AND TRADEMARK OFFICE

CERTIFICATE OF CORRECTION

PATENT NO. : 7,650,003 B1
APPLICATION NO. : 11/298815
DATED : January 19, 2010
INVENTOR(S) : L. DuWayne Hines It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1047 days.

Signed and Sealed this

Twenty-third Day of November, 2010

David J. Kappos

David J. Kappos
*Director of the United States Patent and Trademark Office*